US008153882B2

(12) United States Patent
Adam et al.

(10) Patent No.: US 8,153,882 B2
(45) Date of Patent: Apr. 10, 2012

(54) TIME COMPRESSION/EXPANSION OF SELECTED AUDIO SEGMENTS IN AN AUDIO FILE

(75) Inventors: Thorsten Adam, Hamburg (DE); Oliver Reichhardt, Schenefeld (DE); Robert Hunt, San Jose, CA (US); Clemens Homburg, Hamburg (DE)

(73) Assignee: Apple Inc., Cupertino, CA (US)

( * ) Notice: Subject to any disclaimer, the term of this patent is extended or adjusted under 35 U.S.C. 154(b) by 448 days.

(21) Appl. No.: 12/506,129

(22) Filed: Jul. 20, 2009

(65) Prior Publication Data

US 2011/0011245 A1 Jan. 20, 2011

(51) Int. Cl.
*G10H 1/00* (2006.01)

(52) U.S. Cl. ..... 84/627; 84/609; 84/649; 84/663

(58) Field of Classification Search ..... 84/600–603, 84/609, 627, 645, 649, 663
See application file for complete search history.

(56) References Cited

U.S. PATENT DOCUMENTS

| | | | | |
|---|---|---|---|---|
| 7,189,913 | B2 * | 3/2007 | Moulios et al. | 84/612 |
| 7,425,674 | B2 * | 9/2008 | Moulios et al. | 84/612 |
| 7,610,205 | B2 * | 10/2009 | Crockett | 704/503 |
| 2004/0122662 | A1 * | 6/2004 | Crockett | 704/200.1 |
| 2004/0133423 | A1 * | 7/2004 | Crockett | 704/229 |
| 2004/0196988 | A1 * | 10/2004 | Moulios et al. | 381/119 |
| 2007/0137464 | A1 * | 6/2007 | Moulios et al. | 84/612 |
| 2008/0101711 | A1 * | 5/2008 | Kalker et al. | 382/254 |
| 2009/0259326 | A1 * | 10/2009 | Pipitone et al. | 700/94 |
| 2010/0023864 | A1 * | 1/2010 | Lengeling et al. | 715/727 |
| 2010/0042407 | A1 * | 2/2010 | Crockett | 704/200.1 |
| 2011/0011245 | A1 * | 1/2011 | Adam et al. | 84/612 |

FOREIGN PATENT DOCUMENTS

WO WO 2008/113120 A1 9/2008

OTHER PUBLICATIONS

Mark Cousins, "The latest version of Pro Tools brings the flexibility recording musicians have yearned for. Mark Cousins tries it out . . . ", Digidesign Pro Tools 7.4, MusicTech Magazine, Feb. 2008, pp. 93-94 (Available at http://www.m-audio.com/images/en/reviews/Pro%20Tools%207.4%20Review%20Music%20Tech.pdf, last visited on Jul. 14, 2009).

Eric Nordlund, "Independent Recording Studio Expands Sonic Abilities and Increases Productivity with Ableton Live," Case Study (Ableton Live), www.ericnordlund.com (Available at http://ericnordlund.com/samples/Recovery%20Room%20Case%20Study.pdf, last visited on Jul. 14, 2009).

* cited by examiner

*Primary Examiner* — David S. Warren
(74) *Attorney, Agent, or Firm* — Novak Druce + Quigg LLP

(57) ABSTRACT

A computer implemented method allows a user to adjust tracks in a musical arrangement. The method involves a user selecting a musical position of an audio track, which the user desires to adjust in time, either by compressing it or expanding it, by indicating with a pointing device, such as a mouse, the position in the time line of the audio track that the user wishes to alter. A first marker is then displayed at the selected musical position in the audio track. Boundary markers defining transients in the audio signal surrounding the selected musical position are then automatically generated by analysis of the audio signal, and are displayed on the audio track. The two boundary markers define an audio segment that is to be adjusted in tempo by the user moving the first marker along the time line.

26 Claims, 9 Drawing Sheets

300

400

500

500

TIME COMPRESSION/EXPANSION OF SELECTED AUDIO SEGMENTS IN AN AUDIO FILE

FIELD

The following relates to computing devices capable of and methods for arranging music, and more particularly to approaches for time compression or time expansion of selected audio content in an audio file.

BACKGROUND

Artists can use software to create musical arrangements. This software can be implemented on a computer to allow an artist to write, record, edit, and mix musical arrangements. Typically, such software can allow the artist to arrange files on musical tracks in a musical arrangement. A computer that includes the software can be referred to as a digital audio workstation (DAW). The DAW can display a graphical user interface (GUI) to allow a user to manipulate files or tracks. The DAW can display each element of a musical arrangement, such as a guitar, microphone (voice), or drums, on separate tracks. For example, a user may create a musical arrangement with a guitar on a first track, a piano on a second track, and vocals on a third track. The DAW can further break down an instrument into multiple tracks. For example, a drum kit can be broken into multiple tracks with the snare, kick drum, and hi-hat each having its own track. By placing each element on a separate track a user is able to manipulate a single track, without affecting the other tracks. For example, a user can adjust the volume or pan of the guitar track, without affecting the piano track or vocal track. As will be appreciated by those of ordinary skill in the art, using the GUI, a user can apply different effects to a track within a musical arrangement. For example, volume, pan, compression, expansion, distortion, equalization, delay, and reverb are some of the effects that can be applied to a track.

Typically, a DAW works with two main types of files: MIDI (Musical Instrument Digital Interface) files and audio files. MIDI is an industry-standard protocol that enables electronic musical instruments, such as keyboard controllers, computers, and other electronic equipment, to communicate, control, and synchronize with each other. MIDI does not transmit an audio signal or media, but rather transmits "event messages" such as the pitch and intensity of musical notes to play, control signals for parameters such as volume, vibrato and panning, cues, and clock signals to set the tempo. As an electronic protocol, MIDI is notable for its widespread adoption throughout the industry.

Using a MIDI controller coupled to a computer, a user can record MIDI data into a MIDI track. Using the DAW, the user can select a MIDI instrument that is internal to a computer and/or an external MIDI instrument to generate sounds corresponding to the MIDI data of a MIDI track. The selected MIDI instrument can receive the MIDI data from the MIDI track and generate sounds corresponding to the MIDI data which can be produced by one or more monitors or speakers. For example, a user may select a piano software instrument on the computer to generate piano sounds and/or may select a tenor saxophone instrument on an external MIDI device to generate saxophone sounds corresponding to the MIDI data. If MIDI data from a track is sent to an internal software instrument, this track can be referred to as an internal track. If MIDI data from a track is sent to an external software instrument, this track can be referred to as an external track.

Audio files are recorded sounds. An audio file can be created by recording sound directly into the system. For example, a user may use a guitar to record directly onto a guitar track or record vocals, using a microphone, directly onto a vocal track. As will be appreciated by those of ordinary skill in the art, audio files can be imported into a musical arrangement. For example, many companies professionally produce audio files for incorporation into musical arrangements. In another example, audio files can be downloaded from the Internet. Audio files can include guitar riffs, drum loops, and any other recorded sounds. Audio files can be in sound digital file formats such as WAV, MP3, M4A, and AIFF. Audio files can also be recorded from analog sources, including, but not limited to, tapes and records.

Using the DAW, a user can make tempo changes to a musical composition. The tempo changes affect MIDI tracks and audio tracks differently. In MIDI files, tempo and pitch can be adjusted independently of each other. For example, a MIDI track recorded at 100 bpm (beats per minute) can be adjusted to 120 bpm without affecting the pitch of samples played by the MIDI data. This occurs because the same samples are being triggered by the MIDI data at a faster rate by a clock signal. However, tempo changes to an audio file inherently adjust the pitch of the file as well. For example, if an audio file is sped up (compressed in time), the pitch of the sound goes up. Conversely, if an audio file is slowed down (expanded in time), the pitch of the sound goes down. Conventional DAWs can use a process known as time editing to adjust the tempo of audio while maintaining the original pitch. This process requires analysis and processing of the original audio file. Those of ordinary skill in the art will recognize that various algorithms and methods for adjusting the tempo of audio files while maintaining a consistent pitch can be used.

Time editing is a non-destructive form of audio editing that allows audio content to be time-compressed or time-expanded. In a conventional DAW GUI there is typically a "bar ruler," which defines positions of musical points in a time line of an audio track in accordance with the musical tempo of the audio track. Typically, an initial tempo may be chosen, and optional later tempo changes may be made over the time line of the audio track by adjusting the bar ruler.

SUMMARY

As introduced above, users may desire to adjust the tempo and timing of desired audio segments of an audio track in a DAW. A computer implemented method allows a user to adjust tracks in a musical arrangement. The method involves a user selecting a musical position of an audio track, which the user desires to adjust in time, either by compressing it or expanding it, by indicating with a pointing device, such as a mouse, the position in the time line of the audio track that the user wishes to alter. A first marker is then displayed at the selected musical position in the audio track. Boundary markers defining transients in the audio signal surrounding the selected musical position are then automatically generated by analysis of the audio signal, and are displayed on the audio track. The two boundary markers define an audio segment that is to be adjusted in tempo by the user moving the first marker along the time line. The user can move the first marker in the direction of the boundary marker defining the musical segment that the user wishes to compress in time, while the segment defined by the opposite boundary marker is correspondingly expanded in time, such that the overall time duration of the entire segment remains the same. Pitch-adjusting algorithms are then applied to the altered audio segments to maintain the original pitch of the audio content.

According to one or more embodiments, time-compressed and time-expanded regions are displayed in different colors, with color saturation varying in accordance with the degree of time compression or time expansion.

Many other aspects and examples will become apparent from the following disclosure.

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

DETAILED DESCRIPTION

The functions described as being performed at various components can be performed at other components, and the various components can be combined and/or separated. Other modifications also can be made.

Thus, the following disclosure ultimately will describe systems, computer readable media, devices, and methods for selectively time compressing/expanding audio segments in an audio file using a digital audio workstation. Many other examples and other characteristics will become apparent from the following description.

Figure 1:
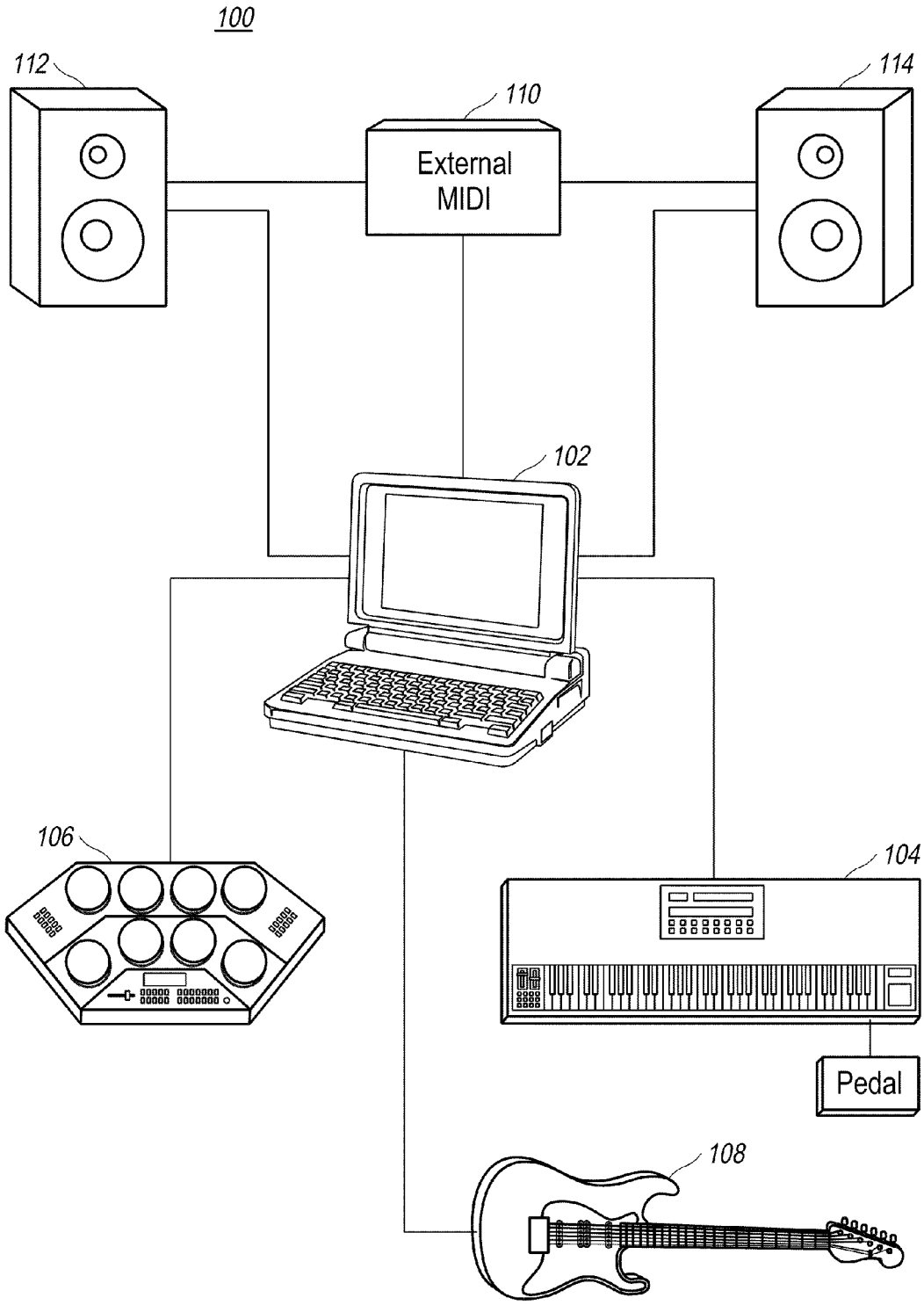
FIG. 1 depicts a block diagram of a system having a DAW musical arrangement in accordance with an exemplary embodiment.

Referring to FIG. 1, a block diagram of a system including a DAW in accordance with an exemplary embodiment is illustrated. As shown, the system 100 can include a computer 102, one or more sound output devices 112, 114, one or more MIDI controllers (e.g. a MIDI keyboard 104 and/or a drum pad MIDI controller 106), one or more instruments (e.g. a guitar 108, and/or a microphone (not shown)), and/or one or more external MIDI devices 110. As would be appreciated by one of ordinary skill in the art, the musical arrangement can include more or less equipment as well as different musical instruments.

The computer 102 can be a data processing system suitable for storing and/or executing program code, e.g., the software to operate the GUI which together can be referred to as a, DAW. The computer 102 can include at least one processor, e.g., a first processor, coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters. In one or more embodiments, the computer 102 can be a desktop computer or a laptop computer.

A MIDI controller is a device capable of generating and sending MIDI data. The MIDI controller can be coupled to and send MIDI data to the computer 102. The MIDI controller can also include various controls, such as slides and knobs, that can be assigned to various functions within the DAW. For example, a knob may be assigned to control the pan on a first track. Also, a slider can be assigned to control the volume on a second track. Various functions within the DAW can be assigned to a MIDI controller in this manner. The MIDI controller can also include a sustain pedal and/or an expression pedal. These can affect how a MIDI instrument plays MIDI data. For example, holding down a sustain pedal while recording MIDI data can cause an elongation of the length of the sound played if a piano software instrument has been selected for that MIDI track.

As shown in FIG. 1, the system 100 can include a MIDI keyboard 104 and/or a drum pad controller 106. The MIDI keyboard 104 can generate MIDI data which can be provided to a device that generates sounds based on the received MIDI data. The drum pad MIDI controller 106 can also generate MIDI data and send this data to a capable device which generates sounds based on the received MIDI data. The MIDI keyboard 104 can include piano style keys, as shown. The drum pad MIDI controller 106 can include rubber pads. The rubber pads can be touch and pressure sensitive. Upon hitting or pressing a rubber pad, or pressing a key, the MIDI controller (104,106) generates and sends MIDI data to the computer 102.

An instrument capable of generating electronic audio signals can be coupled to the computer 102. For example, as shown in FIG. 1, an electrical output of an electric guitar 108 can be coupled to an audio input on the computer 102. Similarly, an acoustic guitar 108 equipped with an electrical output can be coupled to an audio input on the computer 102. In another example, if an acoustic guitar 108 does not have an electrical output, a microphone positioned near the guitar 108 can provide an electrical output that can be coupled with an audio input on the computer 102. The output of the guitar 108 can be coupled to a pre-amplifier (not shown) with the pre-amplifier being coupled to the computer 102. The pre-amplifier can boost the electronic signal output of the guitar 108 to acceptable operating levels for the audio input of computer 102. If the DAW is in a record mode, a user can play the guitar 108 to generate an audio file. Popular effects such as chorus, reverb, and distortion can be applied to this audio file when recording and playing.

The external MIDI device 110 can be coupled to the computer 102. The external MIDI device 110 can include a processor, e.g., a second processor which is external to the first processor 102. The external processor can receive MIDI data from an external MIDI track of a musical arrangement to generate corresponding sounds. A user can utilize such an external MIDI device 110 to expand the quality and/or quantity of available software instruments. For example, a user may configure the external MIDI device 110 to generate electric piano sounds in response to received MIDI data from a corresponding external MIDI track in a musical arrangement from the computer 102.

The computer 102 and/or the external MIDI device 110 can be coupled to one or more sound output devices (e.g., monitors or speakers). For example, as shown in FIG. 1, the computer 102 and the external MIDI device 110 can be coupled to a left monitor 112 and a right monitor 114. In one or more embodiments, an intermediate audio mixer (not shown) may be coupled between the computer 102, or external MIDI device 110, and the sound output devices, e.g., the monitors 112, 114. The intermediate audio mixer can allow a user to adjust the volume of the signals sent to the one or more sound output devices for sound balance control. In other embodiments, one or more devices capable of generating an audio signal can be coupled to the sound output devices 112, 114. For example, a user can couple the output from the guitar 108 to the sound output devices.

The one or more sound output devices can generate sounds corresponding to the one or more audio signals sent to them. The audio signals can be sent to the monitors 112, 114 which can require the use of an amplifier to adjust the audio signals to acceptable levels for sound generation by the monitors 112, 114. The amplifier in this example can be internal or external to the monitors 112, 114.

Although, in this example, a sound card is internal to the computer 102, many circumstances exist where a user can utilize an external sound card (not shown) for sending and receiving audio data to the computer 102. A user can use an external sound card in this manner to expand the number of available inputs and outputs. For example, if a user wishes to record a band live, an external sound card can provide eight (8) or more separate inputs, so that each instrument and vocal can be recorded onto a separate track in real time. Also, disc jockeys (djs) may wish to utilize an external sound card for multiple outputs so that the dj can cross-fade to different outputs during a performance.

Figure 2:
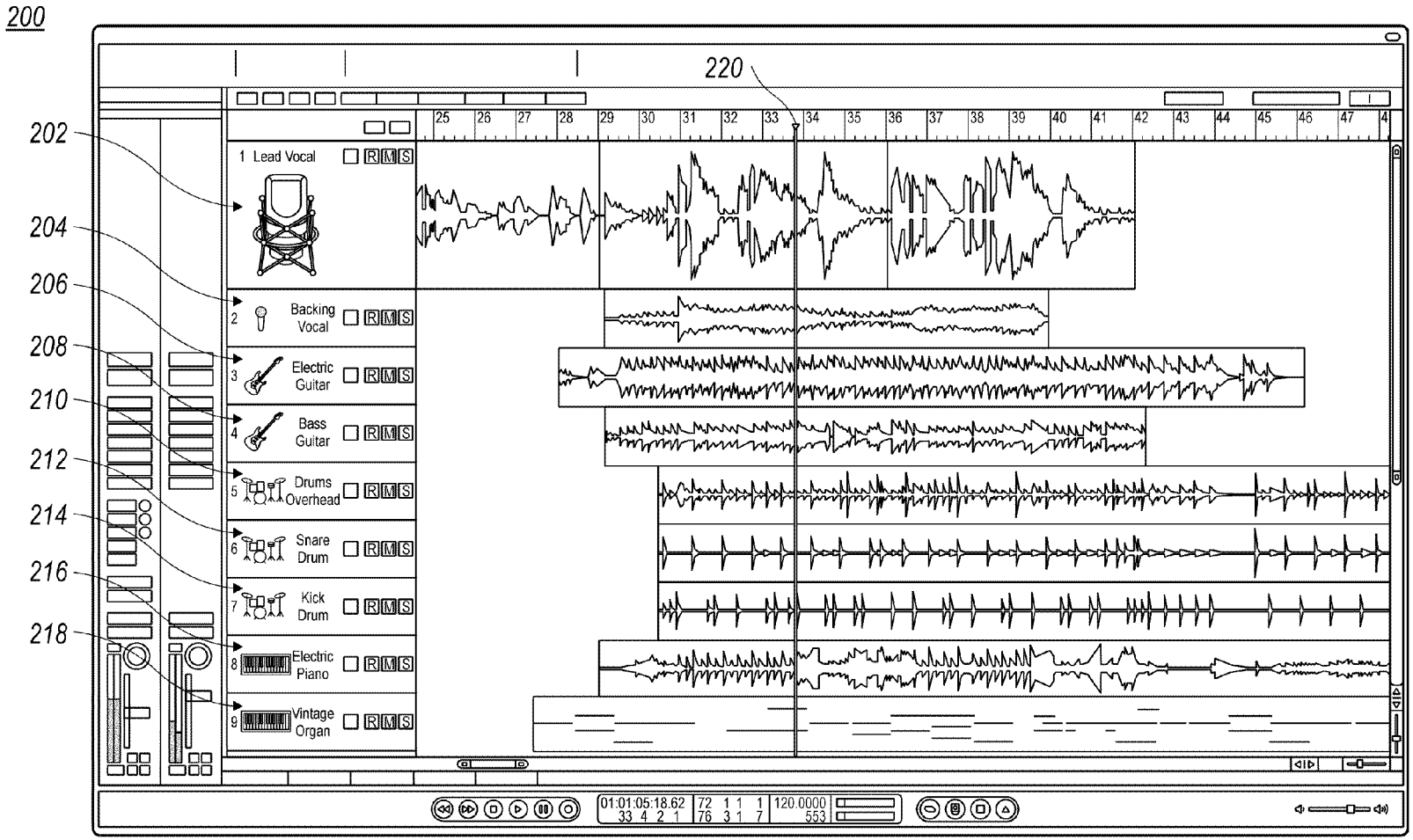
FIG. 2 depicts a screenshot of a GUI of a DAW displaying a musical arrangement including MIDI and audio tracks in accordance with an exemplary embodiment.

Referring to FIG. 2, a screenshot of a musical arrangement in a GUI of a DAW in accordance with an exemplary embodiment is illustrated. The musical arrangement 200 can include one or more tracks with each track having one or more of audio files or MIDI files. Generally, each track can hold audio or MIDI files corresponding to each individual desired instrument. As shown, the tracks are positioned horizontally. A playhead 220 moves from left to right as the musical arrangement is recorded or played. As one of ordinary skill in the art would appreciate, other tracks and playhead 220 can be displayed and/or moved in different manners. The playhead 220 moves along a timeline that shows the position of the playhead within the musical arrangement. The timeline indicates bars, which can be in beat increments. For example as shown, a four (4) beat increment in a 4/4 time signature is displayed on a timeline with the playhead 220 positioned between the thirty-third (33rd) and thirty-fourth (34th) bar of this musical arrangement. A transport bar 222 can be displayed and can include commands for playing, stopping, pausing, rewinding and fast-forwarding the displayed musical arrangement. For example, radio buttons can be used for each command. If a user were to select the play button on transport bar 222, the playhead 220 would begin to move down the timeline, e.g., in a left to right fashion.

As shown, the lead vocal track, 202, is an audio track. One or more audio files corresponding to a lead vocal part of the musical arrangement can be located on this track. In this example, a user has directly recorded audio into the DAW on the lead vocal track. The backing vocal track, 204, is also an audio track. The backing vocal 204 can contain one or more audio files having backing vocals in this musical arrangement. The electric guitar track 206 can contain one or more electric guitar audio files. The bass guitar track 208 can contain one or more bass guitar audio files within the musical arrangement. The drum kit overhead track 210, snare track 212, and kick track 214 relate to a drum kit recording. An overhead microphone can record the cymbals, hit-hat, cow bell, and any other equipment of the drum kit on the drum kit overhead track. The snare track 212 can contain one or more audio files of recorded snare hits for the musical arrangement. Similarly, the kick track 21, can contain one or more audio files of recorded bass kick hits for the musical arrangement. The electric piano track 216 can contain one or more audio files of a recorded electric piano for the musical arrangement.

The vintage organ track 218 is a MIDI track. Those of ordinary skill in the art will appreciate that the contents of the files in the vintage organ track 218 can be shown differently because the track contains MIDI data and not audio data. In this example, the user has selected an internal software instrument, a vintage organ, to output sounds corresponding to the MIDI data contained within this track 218. A user can change the software instrument, for example to a trumpet, without changing any of the MIDI data in track 218. Upon playing the musical arrangement the trumpet sounds would now be played corresponding to the MIDI data of track 218. Also, a user can set up track 218 to send its MIDI data to an external MIDI instrument, as described above.

Each of the displayed audio and MIDI files in the musical arrangement as shown on screen 200 can be altered using the GUI. For example, a user can cut, copy, paste, or move an audio file or MIDI file on a track so that it plays at a different position in the musical arrangement. Additionally, a user can loop an audio file or MIDI file so that it is repeated, split an audio file or MIDI file at a given position, and/or individually time stretch an audio file for tempo, tempo and pitch, and/or tuning adjustments as described below.

Display window 224 contains information for the user about the displayed musical arrangement. As shown, the current tempo in bpm of the musical arrangement is set to 120 bpm. The position of playhead 220 is shown to be at the thirty-third (33rd) bar beat four (4) in the display window 224. Also, the position of the playhead 220 within the song is shown in minutes, seconds etc.

Tempo changes to a musical arrangement can affect MIDI tracks and audio tracks differently. In MIDI files, tempo and pitch can be adjusted independently of each other. For example, a MIDI track recorded at 100 bpm (beats per minute) can be adjusted to 120 bpm without affecting the pitch of the samples played by the MIDI data. This occurs because the same samples are being triggered by the MIDI data, they are just being triggered faster in time. In order to change the tempo of the MIDI file, the signal clock of the relevant MIDI data is changed. However, tempo changes to an audio file inherently adjust the pitch of the file as well. For example, if an audio file is sped up (i.e. time-compressed), the pitch of the sound is raised. Similarly, if an audio file is slowed (i.e., time-expanded), the pitch of the sound is lowered.

In regard to digital audio files, one way that a DAW can change the duration of an audio file to match a new tempo is to resample it. Resampling is a mathematical operation that effectively rebuilds a continuous waveform from its samples and then samples that waveform again at a different rate. When the new samples are played at the original sampling frequency, the audio clip sounds faster or slower. In this method, the frequencies in the sample are scaled at the same rate as the speed, transposing its perceived pitch up or down in the process. In other words, slowing down the recording lowers the pitch, speeding it up raises the pitch.

A DAW can use a process known as time stretching to adjust the tempo of an audio file while maintaining the original pitch. This process requires analysis and processing of the original audio file. Those of ordinary skill in the art will recognize that various algorithms and methods for adjusting the tempo of audio files while maintaining a consistent pitch can be used.

One way that a DAW can stretch the length of an audio file without affecting the pitch is to utilize a phase vocoder. The first step in time-stretching an audio file using this method is to compute the instantaneous frequency/amplitude relationship of the audio file using the Short-Time Fourier Transform (STFT), which is the discrete Fourier transform of a short, overlapping and smoothly windowed block of samples. The next step is to apply some processing to the Fourier transform magnitudes and phases (like resampling the FFT blocks). The third step is to perform an inverse STFT by taking the inverse Fourier transform on each chunk and adding the resulting waveform chunks.

The phase vocoder technique can also be used to perform pitch shifting, chorusing, timbre manipulation, harmonizing, and other modifications, all of which can be changed as a function of time.

Another method that can be used for time shifting audio regions is known as time domain harmonic scaling. This method operates by attempting to find the period (or equivalently the fundamental frequency) of a given section of the audio file using a pitch detection algorithm (commonly the peak of the audio file's autocorrelation, or sometimes cepstral processing), and crossfade one period into another.

The DAW can combine the two techniques (for example by separating the signal into sinusoid and transient waveforms), or use other techniques based on the wavelet transform, or artificial neural network processing, for example, for time stretching. Those of ordinary skill in the art will recognize that various algorithms and combinations thereof for time stretching audio files based on the content of the audio files and desired output can be used by the DAW.

Figure 3A:
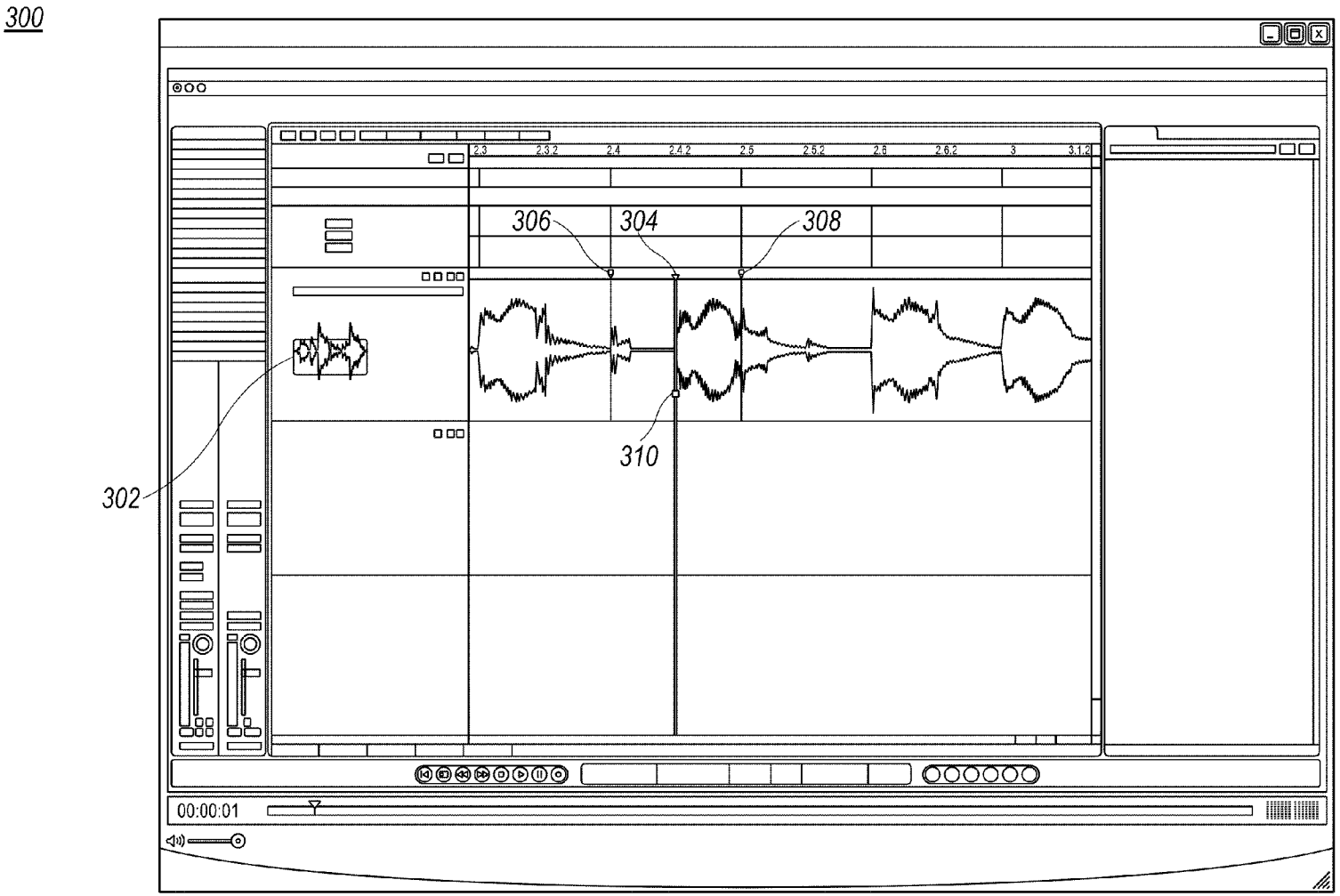
FIG. 3A depicts a screenshot of a GUI of a DAW displaying an automatic time-stretching or "flex" mode of operation in accordance with an exemplary embodiment.

Referring now to FIG. 3A, a screenshot 300 of a GUI of a DAW displays an automatic time-stretching or "flex" mode of operation in accordance with an exemplary embodiment. Here, a particular audio track 302 is selected. For example, a user selects the musical position 310 of content in the audio track 302 that is desired to be moved in time by clicking on the lower half of the audio track with a computer mouse. This causes three flex markers to be created and displayed: a flex marker 304 at the selected position, a transient boundary flex marker 306 at the previous transient location, e.g., a left transient boundary flex marker, and a transient boundary flex marker 308 at the subsequent transient location, e.g., a right transient boundary flex marker. There are two modes of time-stretching flex marker creation that can be used. In the first mode as shown in FIG. 3A, the user clicks on the lower half of the audio track 302. In the second mode explained below with respect to FIG. 4A, the user clicks on the upper half of the audio track 302. These particular conventions are not mandatory and can be reversed—the concept is that clicking on one predefined area of an audio track causes one mode of flex marker creation to be instantiated, and clicking on another predefined area of an audio track causes a second mode of flex marker creation to be instantiated. In other embodiments, only one mode can be implemented.

In FIG. 3A the selected musical position of an audio file can be time-stretched (i.e., either time-expanded or time-compressed) to begin at a different point in the time line, while maintaining the original pitch of the adjusted content, by utilizing an appropriate pitch maintaining algorithm such as a phase vocoder or time domain harmonic scaling. Those of ordinary skill in the art will recognize that various algorithms and combinations thereof for time stretching audio files based on the content of the audio files and desired output can be used by the DAW.

Figure 3B:
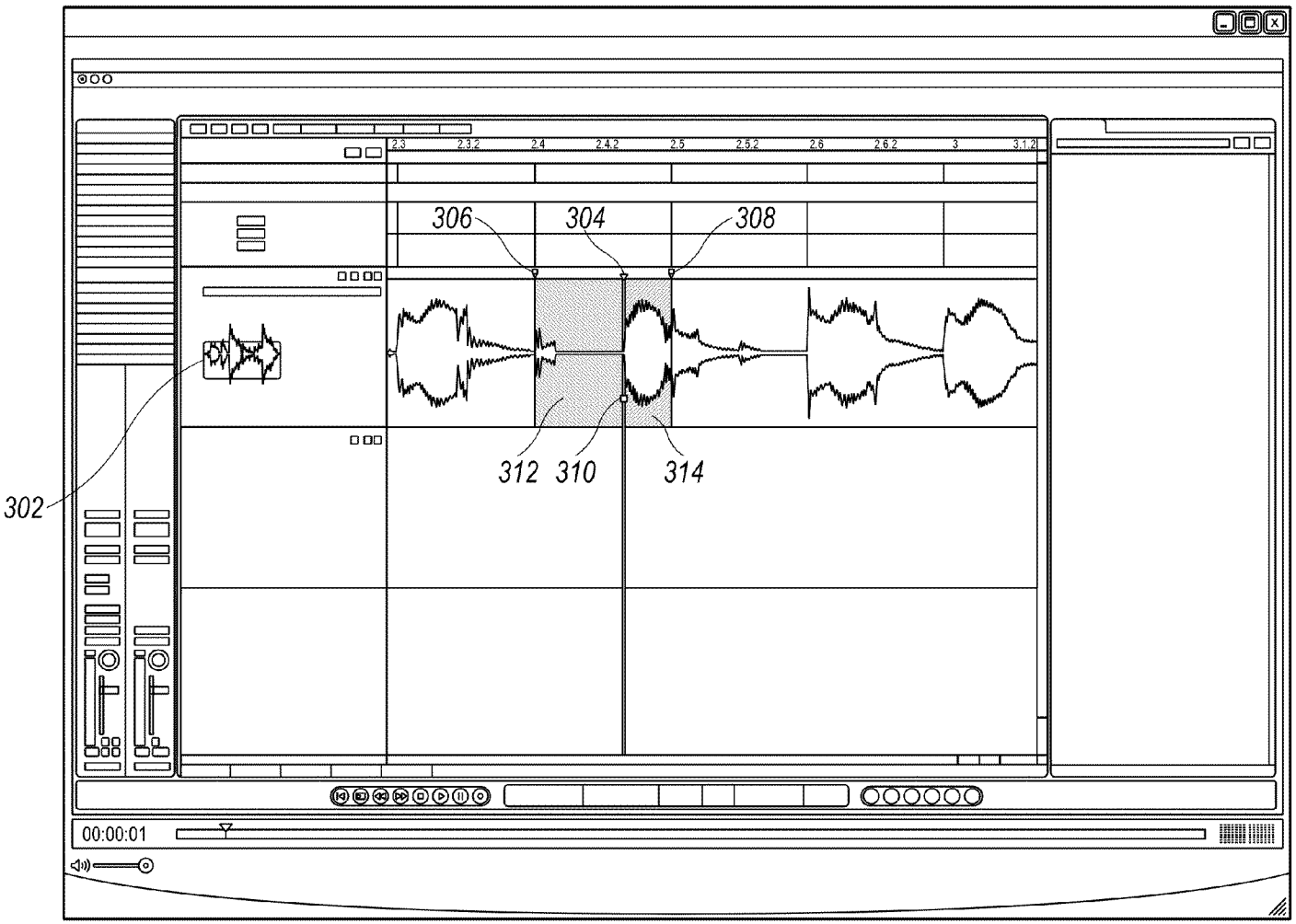
FIG. 3B depicts a screenshot of a GUI of a DAW of a selected musical position of the audio track which has been time-shifted to the right in accordance with an exemplary embodiment.

FIG. 3B shows an example wherein the selected musical position of the audio file in the audio track has been time-shifted to the right in accordance with an exemplary embodiment. Time-shifting of the selection musical position can be done by dragging the flex marker 304 towards transient boundary marker 308. This action causes the audio content between the markers 304 and 308 to be time-compressed, and the audio content between markers 306 and 304 to be time-expanded. In one or more embodiments, the time-compressed area 314 can be indicated by a first color, such as green, while the time-expanded area 312 can be indicated by a second color, such as orange.

Additionally, if the flex marker is moved too close to the adjacent transient boundary, which would require a time-compression higher than a maximum compression factor threshold, and resulting in a distorted audio or a system overload, the affected area can be shown in a third color, such as red, as a warning to the user that the desired compression is too high. Additionally, if the flex marker is moved beyond one of the first transient boundary and second transient boundary, the processor can adjust the first transient boundary and second transient boundary farther apart, to the immediately next adjacent transients.

Figure 4A:
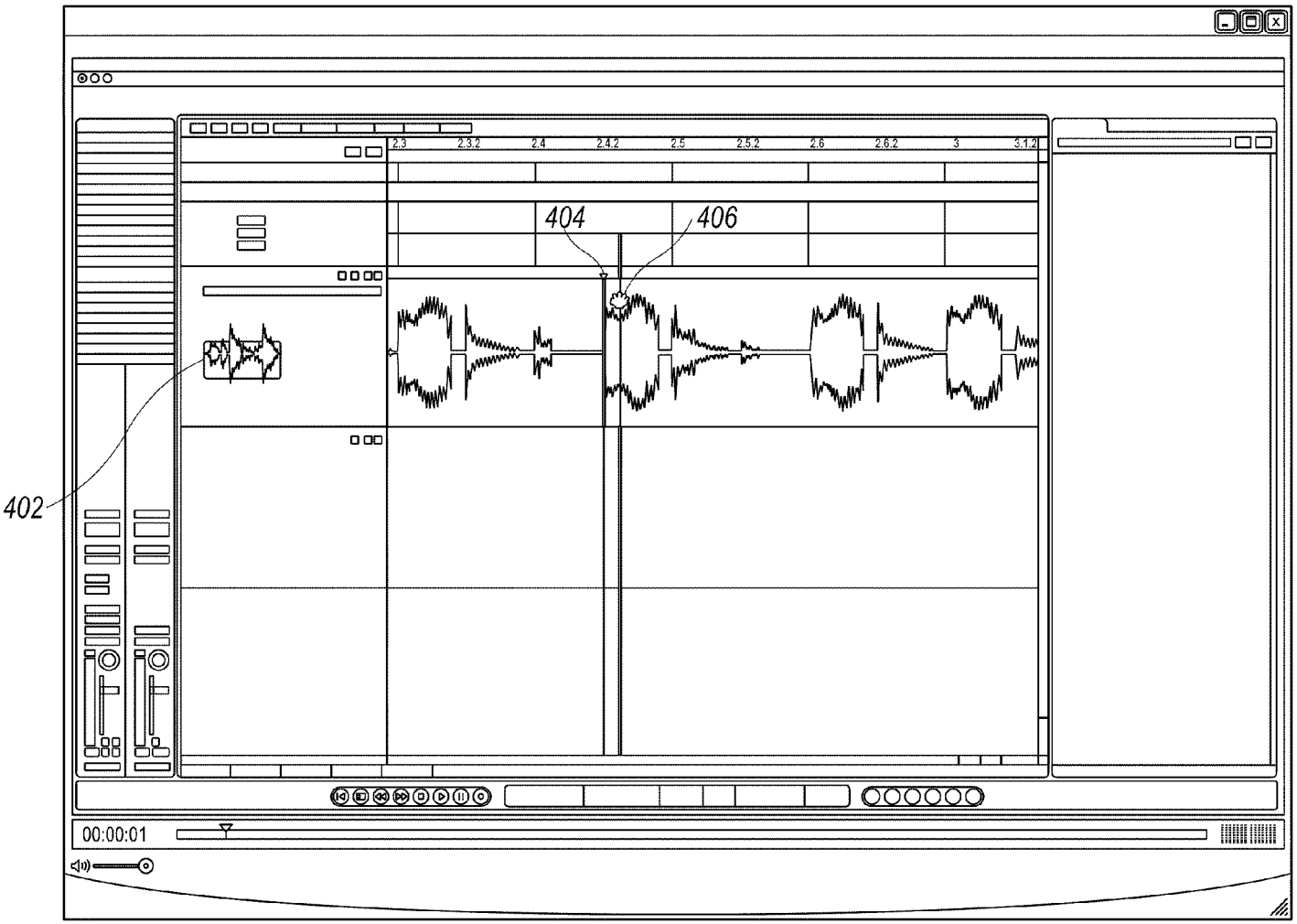
FIGS. 4A-4B depict screenshots of a GUI of a DAW of another mode of flex markers in accordance with exemplary embodiments.
Figure 4B:
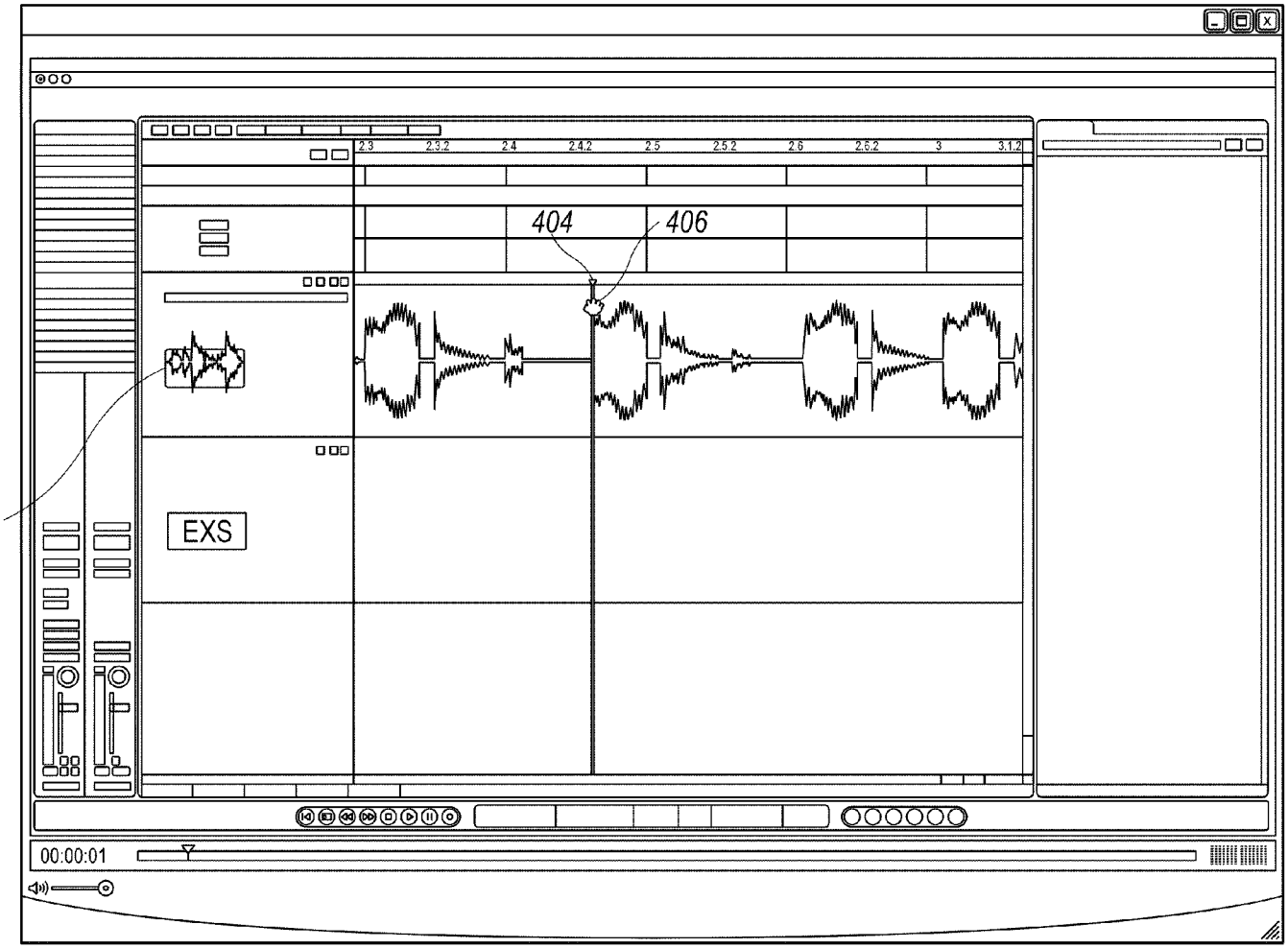

FIGS. 4A-4B show a GUI screenshot 400 of a second mode of flex marker creation in accordance with exemplary embodiments. To create the flex markers, a user can click on an upper area of the audio track 402 at a selected musical position 404, intending to time shift the entire audio file from that position, e.g., to the right, later in time, to position 406. In this embodiment, only one flex marker is created, as shown in FIG. 4A at selected musical position 404. The user then grabs and drags the flex marker from a first position 404 to a second position 406, as shown in FIG. 4B, using the computer mouse. In this embodiment, the entire audio content from the second position 406 to the end of the audio file is time-compressed, while the entire audio content from the beginning of the audio file to the second position 406 is time-expanded. In this embodiment, the beginning and end of the audio file serve as boundaries for the time-stretching algorithms.

Figure 5A:
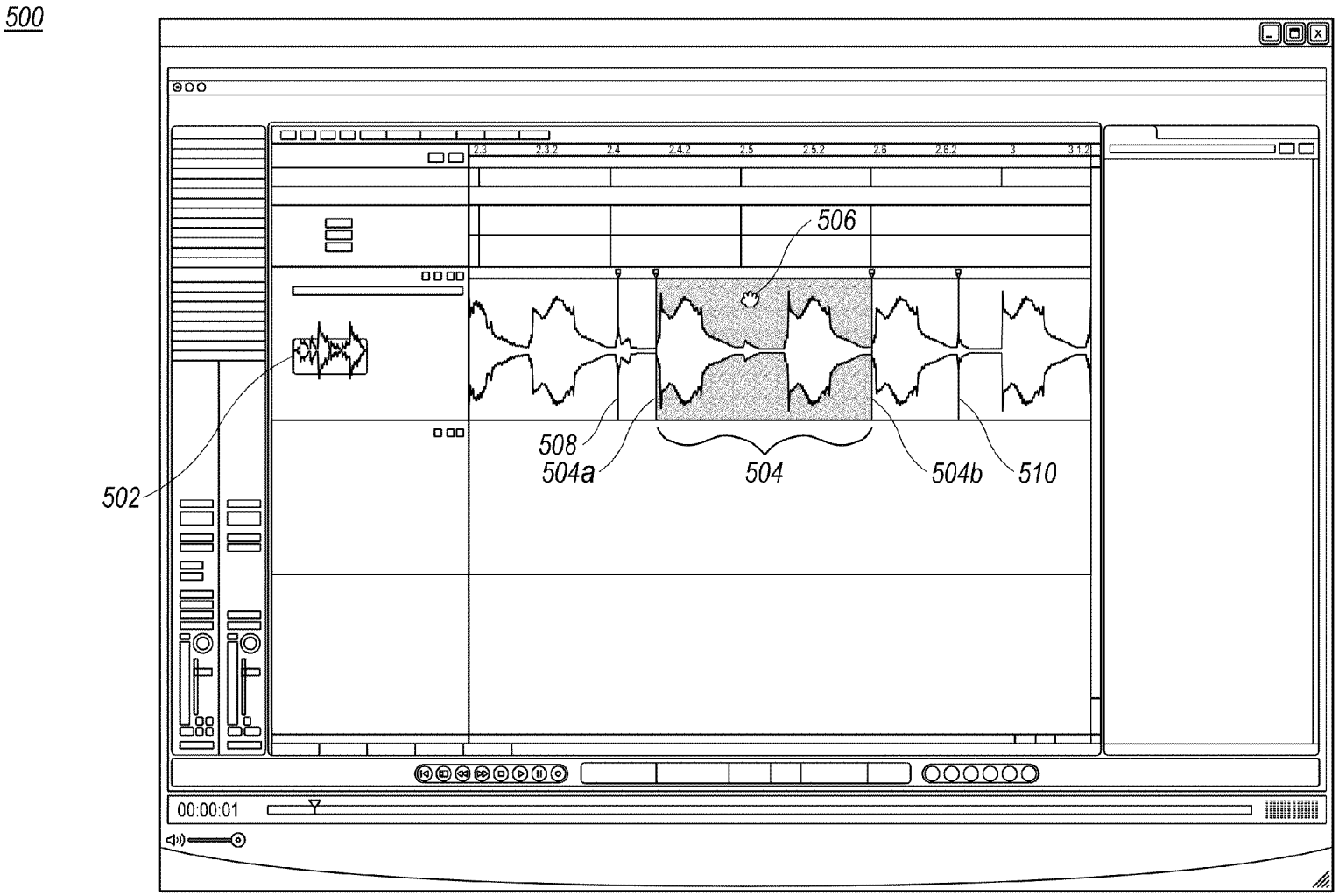
FIGS. 5A-5B depict screenshots of a "marquee" tool used to select a defined region of the audio file in accordance with exemplary embodiments.
Figure 5B:
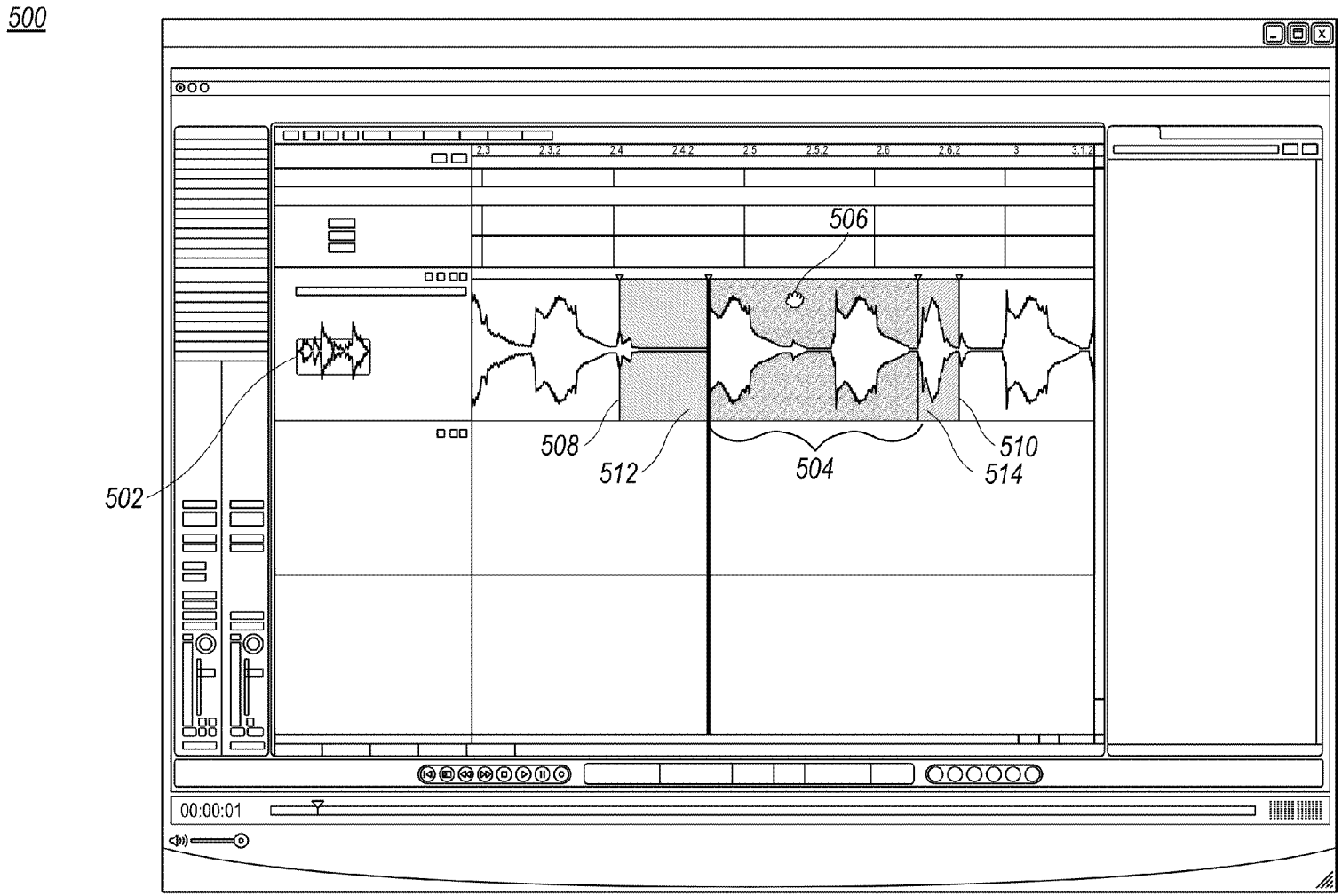

FIGS. 5A-5B depict screenshots of a "marquee" tool used to select a defined region of the audio file rather than only a position in accordance with exemplary embodiments. The marquee tool can be selected by the user in a number of conventional ways, such as using a drop-down window, clicking on an icon, accessing an options menu, etc. The marquee tool can be used when a segment of the audio file is desired to be shifted in time, either earlier or later, but the tempo of the segment itself is not desired to be sped-up or slowed-down.

Referring to FIG. 5A, a screenshot 500 of a GUI of a DAW displaying an audio track 502 is illustrated. Using the marquee tool, a user can click at a desired position 504*a* of the audio track using a computer mouse, and creates a marquee region 504 by dragging the pointer to an end position 504*b* of the desired marquee region. The length of marquee region 504 thus may be varied by the user. Alternatively, a preset length marquee region can be created by a user clicking on an initial position of the audio track. Upon defining the marquee region 504, first and second transient boundary markers 508 and 510 can be automatically created by the DAW. To move the created marquee region 504, the user can point a grabbing icon 506 within the region 504 and drags the marquee region to the left or right within the audio track as desired.

FIG. 5B illustrates an example in which the user shifts the marquee region 504 to a later point in time within the audio track 502. As shown, the original audio content within the region 504 has not been altered, but remains at the same playback speed. A first area 514 has been time-compressed, and can be displayed in a first color such as green, while a second area 512 has been time-expanded, and can be displayed in a second color such as orange, in the same manner as the first embodiment. The intensities of the displayed colors may vary in accordance with the amount of time-compression and time-expansion indicated by the amount of movement of the marquee region 504 within the audio track.

The marquee embodiment also can include a "global" mode wherein transient boundary markers are not created at the immediately adjacent transients, but instead the beginning and end of the audio file are considered the boundary markers for purposes of determining the audio content to be time-expanded or time-compressed.

Figure 6:
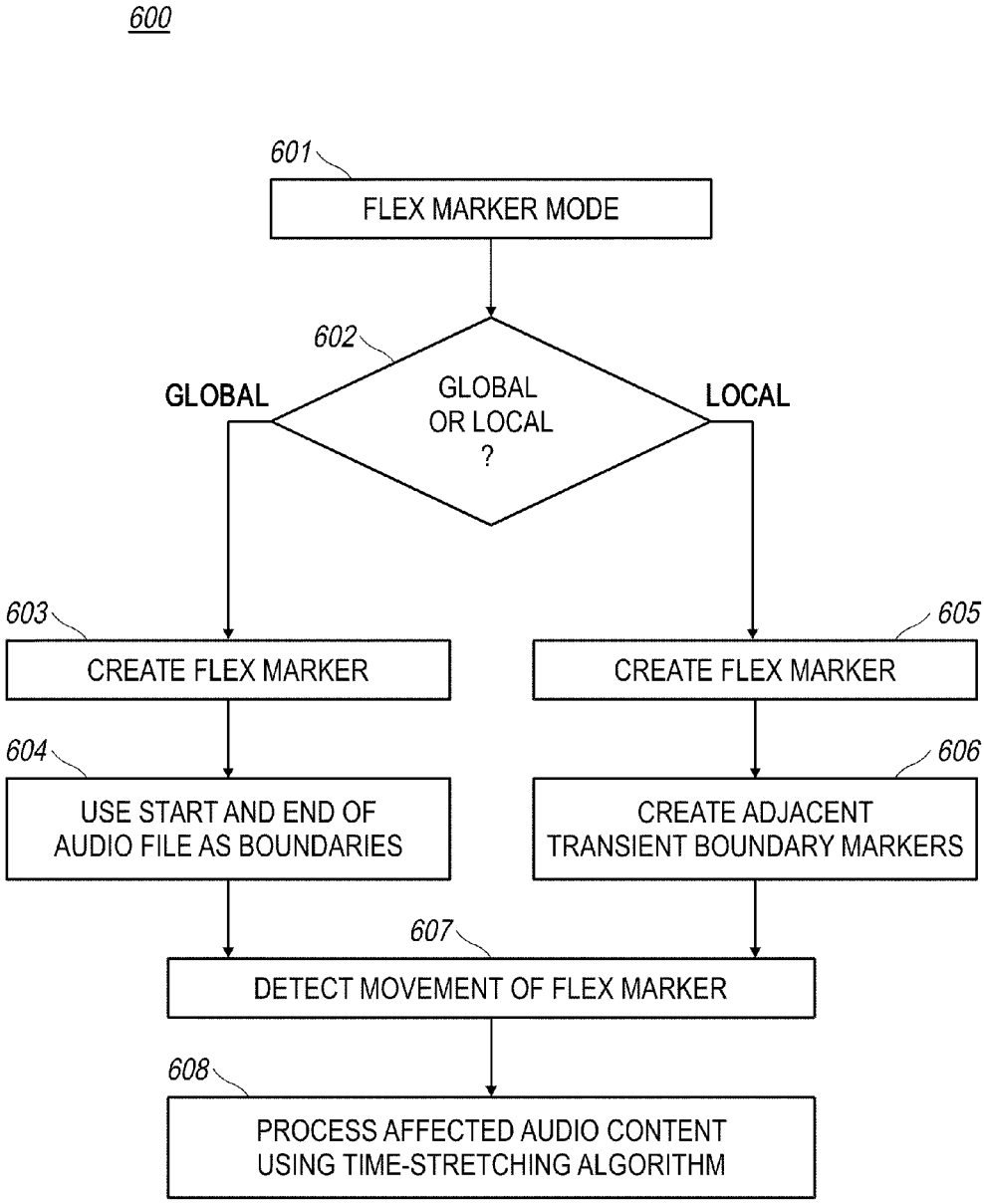
FIG. 6 illustrates a flow chart of a method for time compressing/expanding selected portions of an audio file in accordance with an exemplary embodiment.

Referring to FIG. 6, a flow chart of a method for creating flex markers for time adjustment of an audio file in an audio track in accordance with an exemplary embodiment is illustrated. The exemplary method 600 is provided by way of example, as there are a variety of ways to carry out the method. In one or more embodiments, the method 600 is performed by the computer 102 of FIG. 1. The method 600 can be executed or otherwise performed by one or a combination of various systems. The method 600 described below can be carried out using the devices illustrated in FIG. 1 by way of example, and various elements of this figure are referenced in explaining exemplary method 600. Each block shown in FIG. 600 represents one or more processes, methods or subroutines carried out in exemplary method 600. The exemplary method 600 can begin at block 601.

At first, at least one audio track is displayed. For example, the computer 102, e.g., a processor or a processor module, causes the display of the at least one audio track 302 as shown in FIGS. 3A-3B.

At block 601, a user enters the flex marker mode of the displayed audio track. This can be accomplished using any of a number of various methods, such as by accessing a pull-down menu, clicking on a tool icon, etc. For example, the processor or processor module receives one or more inputs to enter the flex marker mode. At block 602, a determination is made whether the "local" flex marker mode or "global" flex marker mode was selected. For example, the user clicks at a desired time position in the audio track, and the processor or processor module determines whether the click was in an upper or lower half of the audio track area, to determine whether a global flex marker mode or a local flex marker mode should be initiated.

If the global mode has been selected, then at step 603 a single flex marker is created at the musical position in the audio track at which the user clicked. For example, the processor or processor module causes the display of a single flex marker at the position of the audio file that the user selected. At step 604, the start and end of the audio file are selected as boundary markers for purposes of processing the audio content using an appropriate time-stretching algorithm. For example, the processor or processor module causes the display of boundary markers at the beginning and end of the audio file. Conversely, if the local mode has been selected, then at step 605 a flex marker is created at the musical position in the audio track at which the user clicked, and at step 606 first and second transient boundary markers are created at the immediately adjacent transients surrounding the created flex marker. For example, the processor or processor module creates the flex marker and determines where the first and second transient boundary markers are and the processor or processor module causes the display of the flex marker, first transient boundary marker, and the second transient boundary marker.

At step 607, the amount of movement of the flex marker by the user is detected. The amount of movement can be used to determine the color and intensity of color to be displayed in the regions between the boundary markers and the flex marker, as described above. For example, the processor or processor module determines the amount of movement and the processor or processor module causes the display of the regions in the respective color.

When the user is satisfied with his or her selection, then at step 608 the affected audio content is processed using an appropriate time-stretching (pitch adjusting) algorithm to effect the indicated time-expansion and time-compression by the amount of movement of the flex marker. For example, the processor or processor module processes and adjusts the affected audio content.

The marquee mode of the present invention is analogous to the procedure described in FIG. 6, except that instead of creating a single flex marker, a pair of flex markers is created that together define a marquee region 504 as described above.

A track in a DAW can contain multiple files. Any selective time compression/expansion done by the DAW on an audio file can be anchored to the audio content in the audio file. Therefore, a user can move an audio file that has been selectively time compressed/or expanded to a different location in a musical arrangement and the audio file can retain the selective time compression/expansion.

The technology can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. Both processors and program code for implementing each as aspect of the technology can be centralized and/or distributed as known to those skilled in the art.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

We claim:

1. A computer-implemented method for adjusting timing of a selected portion of an audio recording, the method comprising in a processor:

analyzing an audio recording for transients;

causing the display of a waveform corresponding to the audio recording and an associated time line;

receiving a selection command selecting a position in the displayed audio recording waveform;

causing the display of, in response to the selection command, an indication of the selected position and a first transient boundary and a second transient boundary surrounding the selected position;

receiving an indication of the direction and magnitude of movement of the displayed selected position by a user to an adjusted position, corresponding to a desired amount of time adjustment of a selected sound segment in said audio recording; and causing the display of, in response to the received movement indication, an adjusted audio recording waveform, with a first section between the first boundary and the adjusted position of the selected position indicating one of a compression of the audio content therein and an expansion of the audio content therein, and a second section between the adjusted position of the selected position and the second boundary indicating one of compression of the audio content therein and expansion of the audio content therein.

2. The method of claim 1 wherein the processor causes the display of the first section or second section in a first color in the event the audio content is compressed and causes the display of the first section or second section in a second color in the event the audio content is expanded.

3. The method of claim 2 wherein the display of color includes a saturation level which varies in accordance with the amount of compression or expansion of the affected audio content within a defined section of the audio recording waveform displayed.

4. The method of claim 2 wherein the processor causes the display of the first section or second section in a third color in the event the audio content would be compressed or expanded beyond a corresponding predetermined threshold, as indicated by the magnitude of movement of the selected position.

5. The method of claim 1 wherein the pitch of compressed audio content and of expanded audio content is not changed from their original pitch prior to compression or expansion.

6. The method of claim 1 wherein in the event the selected position is moved beyond one of the first transient boundary and second transient boundary, the processor adjusts at least one of the first transient boundary and the second transient boundary farther apart and causes the display of the adjusted boundary.

7. The method of claim 1 wherein the first boundary and second boundary are positioned at detected transients on either side of the selected position.

8. The method of claim 1 wherein the first boundary and second boundary are positioned at the beginning and end of said audio recording waveform.

9. The method of claim 1, further comprising detecting a vertical location of selection of said position and creating a different pair of boundaries in accordance with said location.

10. A computer-implemented method for adjusting timing of a selected portion of an audio recording, comprising:

analyzing, by a processor, an audio recording for transients;

causing the display of, by the processor, a waveform corresponding to the audio recording and an associated time line;

receiving, by the processor, a selection command selecting a region in the displayed audio recording waveform;

causing the display of, by the processor in response to the selection command, an indication of the selected region and a first transient boundary and a second transient boundary surrounding the selected region;

receiving, by the processor, an indication of the direction and magnitude of movement of the displayed selected region by a user to an adjusted position, corresponding to a desired amount of time adjustment of said selected region in said audio recording; and causing the display of, by the processor in response to the received movement indication, an adjusted audio recording waveform, with a first section between the first boundary and the adjusted position of the selected region indicating one of a compression of the audio content therein and an expansion of the audio content therein, and a second section between the adjusted position of the selected region and the second boundary indicating one of compression of the audio content therein and expansion of the audio content therein.

11. The method of claim 10 wherein the processor causes the display of the first section or second section in a first color in the event the audio content is compressed and causes the display of the first section or second section in a second color in the event the audio content is expanded.

12. The method of claim 11 wherein the display of color includes a saturation level which varies in accordance with the amount of compression or expansion of the affected audio content within a defined section of the audio recording waveform displayed.

13. The method of claim 11 wherein the processor causes the display of the first section or second section in a third color in the event the audio content would be compressed or expanded beyond a corresponding predetermined threshold, as indicated by the magnitude of movement of the selected position.

14. The method of claim 10 wherein the pitch of compressed audio content and of expanded audio content is not changed from their original pitch prior to compression or expansion.

15. The method of claim 10 wherein in the event the selected position is moved beyond one of the first transient boundary and second transient boundary, the processor adjusts at least one of the first transient boundary and second transient boundary farther apart and causes the display of the adjusted boundary.

16. The method of claim 10 wherein the first boundary and second boundary are positioned at detected sound event transients on either side of the selected region.

17. The method of claim 10 wherein the first boundary and second boundary are positioned at the beginning and end of said audio recording waveform.

18. The method of claim 10, further comprising detection by the processor of a vertical location of selection of said position, and creation of a different pair of boundaries in accordance with said location.

19. A system for adjusting timing of a selected portion of an audio recording, comprising:

a display device;

an input device for navigating the display device; and a processor coupled to the display device and the input device, the processor further adapted to:

analyze an audio recording for transients;

cause the display of a waveform on the display device, wherein the waveform corresponds to the audio recording and an associated time line;

receive a selection command selecting a position in the displayed audio recording waveform;

cause the display of, in response to the selection command, an indication of the selected position and a first transient boundary and a second transient boundary surrounding the selected position;

receive an indication of the direction and magnitude of movement of the displayed selected position by a user to an adjusted position, corresponding to a desired amount of time adjustment of a selected sound segment in said audio recording; and cause the display of, in response to the received movement indication, an adjusted audio recording waveform, with a first section between the first boundary and the adjusted position of the selected position indicating one of a compression of the audio content therein and an expansion of the audio content therein, and a second section between the adjusted position of the selected position and the second boundary indicating one of compression of the audio content therein and expansion of the audio content therein.

20. The system of claim 19 wherein the processor causes the display of the first section or second section in a first color in the event the audio content is compressed and causes the display of the first section or second section in a second color in the event the audio content is expanded.

21. The system of claim 19 wherein the pitch of compressed audio content and of expanded audio content is not changed from their original pitch prior to compression or expansion.

22. The system of claim 19 wherein in the event the selected position is moved beyond one of the first transient boundary and second transient boundary, the processor adjusts the first transient boundary and second transient boundary farther apart and causes the display of the adjusted first boundary and adjusted second boundary.

23. A computer program product for adjusting timing of a selected portion of an audio recording comprising:

a computer-readable medium; and a processing module residing on the computer-readable medium and operative to:

analyze an audio recording for transients;

cause the display of a waveform corresponding to the audio recording and an associated time line;

receive a selection command selecting a position in the displayed audio recording waveform;

cause the display of, in response to the selection command, an indication of the selected position and a first transient boundary and a second transient boundary surrounding the selected position;

receive an indication of the direction and magnitude of movement of the displayed selected position by a user to an adjusted position, corresponding to a desired amount of time adjustment of a selected sound segment in said audio recording; and cause the display of, in response to the received movement indication, an adjusted audio recording waveform, with a first section between the first boundary and the adjusted position of the selected position indicating one of a compression of the audio content therein and an expansion of the audio content therein, and a second section between the adjusted position of the selected position and the second boundary indicating one of compression of the audio content therein and expansion of the audio content therein.

24. The computer program product of claim 23 wherein the processor causes the display of the first section or second section in a first color in the event the audio content is compressed and causes the display of the first section or second section in a second color in the event the audio content is expanded.

25. The computer program product of claim 24 wherein the pitch of compressed audio content and of expanded audio content is not changed from their original pitch prior to compression or expansion.

26. The computer program product of claim 24 wherein in the event the selected position is moved beyond one of the first transient boundary and second transient boundary, the processor adjusts the first transient boundary and second transient boundary farther apart and causes the display of the adjusted first boundary and adjusted second boundary.

* * * * *